US006799704B2

(12) United States Patent
Carleton

(10) Patent No.: US 6,799,704 B2
(45) Date of Patent: Oct. 5, 2004

(54) DRYWALL TOOL

(76) Inventor: John P. Carleton, 11001 Totem Rd., Anchorage, AK (US) 99516

( * ) Notice: Subject to any disclaimer, the term of this patent is extended or adjusted under 35 U.S.C. 154(b) by 205 days.

(21) Appl. No.: 10/244,161

(22) Filed: Sep. 16, 2002

(65) Prior Publication Data

US 2004/0050878 A1 Mar. 18, 2004

(51) Int. Cl.[7] ..... B65D 83/00
(52) U.S. Cl. ..... 222/401; 222/567
(58) Field of Search ..... 222/401, 566, 222/567

(56) References Cited

U.S. PATENT DOCUMENTS

| | | | | | |
|---|---|---|---|---|---|
| 337,919 | A | * | 3/1886 | Bean | 222/401 |
| 925,242 | A | * | 6/1909 | Steinwand | 222/567 |
| 2,730,838 | A | * | 1/1956 | Wilson | 47/1.01 R |
| 4,127,434 | A | * | 11/1978 | Lass | 156/526 |
| 5,199,455 | A | * | 4/1993 | Dlouhy | 137/217 |
| 5,338,128 | A | | 8/1994 | Blanco | 403/206 |
| 5,497,812 | A | | 3/1996 | Orosco et al. | 141/21 |
| 5,535,926 | A | | 7/1996 | Blitz et al. | 222/334 |
| 5,863,146 | A | | 1/1999 | Denkins et al. | 401/188 R |
| 5,878,925 | A | | 3/1999 | Denkins et al. | 222/608 |
| 5,882,691 | A | | 3/1999 | Conboy | 425/87 |
| 6,299,686 | B1 | | 10/2001 | Mills | 118/207 |
| 6,378,738 | B1 | | 4/2002 | Speaker et al. | 222/330 |
| 6,450,723 | B1 | * | 9/2002 | Lithgow | 401/266 |
| 6,482,356 | B1 | * | 11/2002 | Brown | 422/1 |

* cited by examiner

*Primary Examiner*—Joseph A. Kaufman
(74) *Attorney, Agent, or Firm*—Richard C. Litman

(57) ABSTRACT

A dry wall tool includes a tubular, L-shaped device having a tapered end. A sleeve is disposed around the tapered end. The other end of the tubular device is adapted to receive an existing filler nozzle or it may be fitted with its own filler nozzle. The tapered end is adapted for removable insertion into an open end of the gooseneck of a dry wall mud pump. A finger ring is disposed on the outer surface of the device so that the device may be easily manipulated. The device eliminates the requirement for the box filler adapter and for wrenches needed when switching from bazooka tools to box tools.

12 Claims, 2 Drawing Sheets

DRYWALL TOOL

BACKGROUND OF THE INVENTION

1. Field of the Invention

The present invention generally relates to construction tools. More specifically, the present invention is drawn to a device adapted to be utilized with existing drywall taping and finishing tools.

2. Description of the Related Art

In the construction industry, drywall has become the material of choice in the production of interior walls and ceilings. As currently practiced, the finishing of drywall surfaces is a time-consuming job in that wrenches and the like must be utilized to remove the gooseneck before various types of finishing tools (bazookas and box tools) can be switched for attachment to the mud pump. Because of constant removal, the existing systems also require the replacement of a gasket located between the pump head and the adapters. To avoid the hassle of changing from one type tool to the other, many dry wall finishers purchase two pumps to run both types of finishing tools without changing. A simple tool which would alleviate the tedious, time-consuming switching process and eliminate the need for purchasing a costly second pump would certainly be a welcome addition to the art.

Examples of prior art mud pump apparatus are disclosed in U.S. Pat. No. 5,497,812 (Orosco et al.), U.S. Pat. No. 5,878,925 (Denkins et al.) and U.S. Pat. No. 6,299,686 B1 (Mills). Note that in each patent the gooseneck must be removed before another type finishing tool can be attached.

U.S. Pat. No. 5,882,691 (Conboy) is drawn to a dry wall applicator (bazooka) having a quick release mechanism. There is no teaching for connecting other tools directly to the gooseneck.

U.S. Pat. No. 6,378,738 B1 (Speaker et al.) shows a diverter valve for alternately filling two different types of drywall mud applicator devices. The diverter valve is somewhat complicated to assemble to the pump and gooseneck.

U.S. Pat. No. 5,338,128 (Blanco), U.S. Pat. No. 5,863,146 (Denkins et al.) and U.S. Pat. No. 5,535,926 (Blitz et al.) all disclose finishing tools for drywall. The instant patents are not concerned with the attachment of different dry wall tools to a mud pump.

None of the above inventions and patents, taken either singly or in combination, is seen to disclose a tool adapted to be attached to the gooseneck of a mud pump as will subsequently be described and claimed in the instant invention.

SUMMARY OF THE INVENTION

The present invention is a tubular, L-shaped device having a tapered end adapted for removable insertion into an open end of the gooseneck of a dry wall mud pump. In a preferred embodiment a sleeve is disposed around the tapered end to secure the device to the gooseneck. However, the sleeve may be eliminated and the device itself may be made to be continuous and slide over the gooseneck. In any case, the device will be adaptable to fit different designs of goosenecks. The other end of the tubular device is adapted to receive an existing filler nozzle or it may be fitted with its own filler nozzle. A finger ring is disposed on the outer surface of the device so that the device may be easily manipulated. The device eliminates the requirement for the box filler adapter and for wrenches needed when switching from bazooka tools to box tools.

Accordingly, it is a principal object of the invention to provide a device, which device can be utilized to eliminate the required removal of the gooseneck from a dry wall mud pump when switching from bazooka tools to box tools.

It is another object of the invention to provide a device, which device can be inserted directly into the gooseneck of a dry wall mud pump.

It is a further object of the invention to provide a device, which device can be quickly and easily attached directly to the gooseneck of a dry wall mud pump.

Still another object of the invention is to provide a device, which device is rugged and easy to manipulate.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
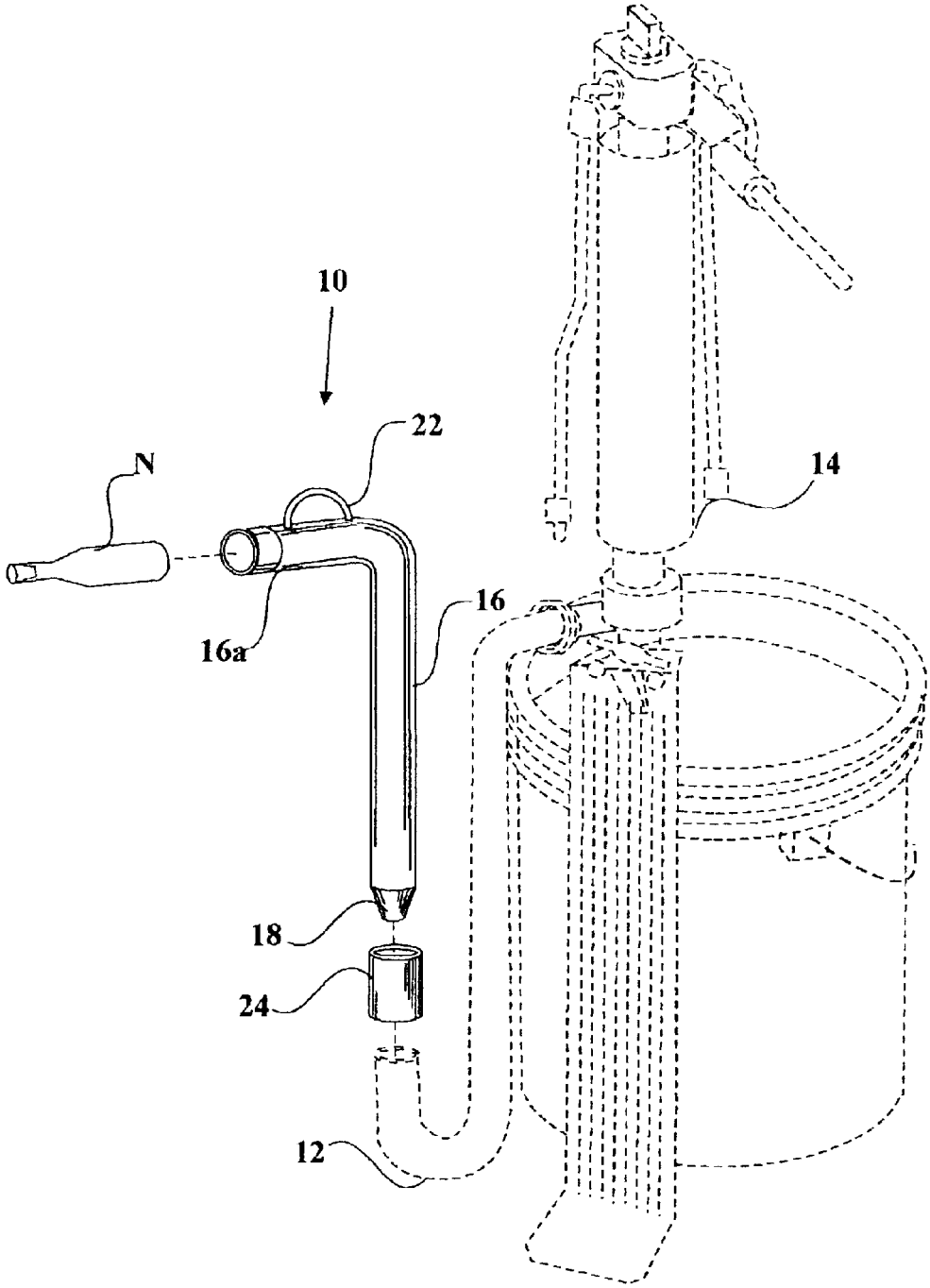
FIG. 1 is an environmental, perspective view of a drywall tool according to the present invention.
Figure 2:
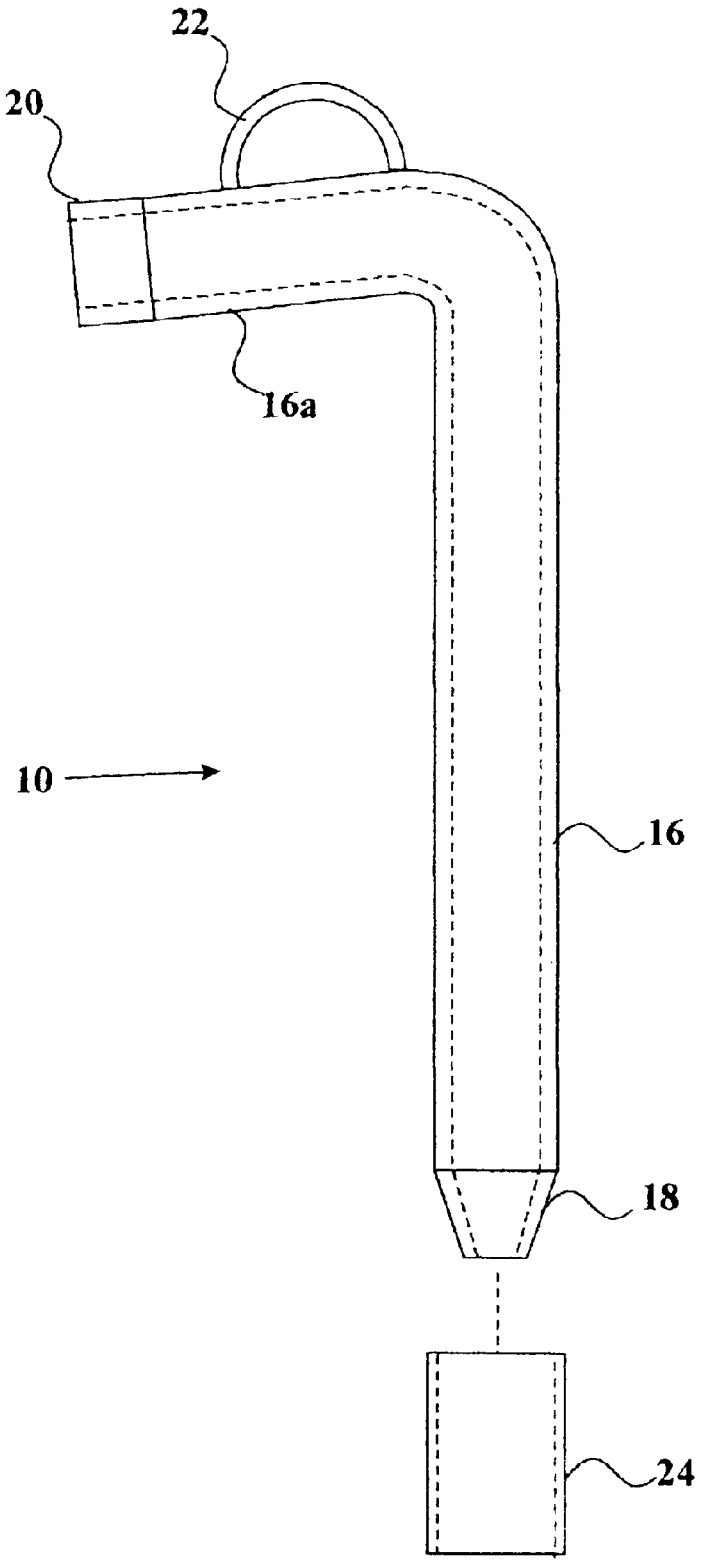
FIG. 2 is a plan view of a dry wall tool according to the present invention.

As illustrated in FIGS. 1 and 2, the device of the present invention is generally indicated at 10. Device 10 is adapted to be inserted into the gooseneck 12 of a dry wall mud pump 14. Gooseneck 12 and mud pump 14 (both shown in phantom lines) are conventional and are not, per se, part of the inventive concept.

Device 10 comprises a tube formed with approximately a ninety degree angle so as to form an L-shaped tubular member having a vertical leg 16 and a horizontal leg 16*a*. Vertical leg 16 is provided with a tapered end 18 which is sized to fit within the opening of conventional gooseneck 12. As contemplated, the tubular member will be fabricated from a one inch diameter tube. The tube may be fabricated from any suitable material (PVC, Teflon, stainless steel, etc.). Vertical leg 16 has a length of approximately nine and one-fourth inches. Horizontal leg 16*a* has a length of approximately three and one-third inches. Leg 16*a* terminates in an end having a fitting 20 sized to receive an existing filler nozzle N or optionally its own filler nozzle. A finger ring 22 is attached to the outer surface of leg 16*a* to facilitate insertion and removal to and from the gooseneck. A sleeve 24 is sized and positioned to encompass tapered end 18 and the end of gooseneck 12 so as to enhance coupling of the device to the gooseneck.

Utilizing the device of the instant invention does not require removal of the gooseneck when a user switches from a bazooka type tool to box filler tools. The user merely inserts the tapered end of the device into the gooseneck and attaches the desired filler nozzle to the other end of the device.

It is to be understood that the present invention is not limited to the embodiment described above, but encompasses any and all embodiments within the scope of the following claims.

I claim:

1. The combination of a dry wall mud pump having a gooseneck and a device for securement to the gooseneck, comprising:

a dry wall mud pump having a gooseneck; and a device for securement to the gooseneck, the device including:

an L-shaped tubular member having a vertical leg said vertical leg terminating in a first end;

a horizontal leg, said horizontal leg extending substantially perpendicularly from said vertical leg and terminating in a second end;

a tapered portion defining said first end, said tapered portion adapted to be inserted into the gooseneck;

a fitting defining said second end, said fitting adapted to receive a filler nozzle; and a sleeve, said sleeve positioned on said first end and encompassing said tapered portion.

2. The combination as recited in claim 1, wherein:

said horizontal leg has an outer surface; and said device further comprises a finger ring, said finger ring being attached to the outer surface of said horizontal leg member.

3. The combination as recited in claim 2, wherein said vertical leg member has a length of approximately nine and one-fourth inches.

4. The combination as recited in claim 3, wherein said horizontal leg member has a length of approximately three and one-third inches.

5. The combination as recited in claim 4, wherein said tubular member is fabricated from a metallic material.

6. The combination as recited in claim 4, wherein said tubular member is fabricated from a plastic material.

7. A device for securement to the gooseneck of a dry wall mud pump, said device comprising;

an L-shaped tubular member having a vertical leg said vertical leg terminating in a first end;

a horizontal leg, said horizontal leg extending substantially perpendicularly from said vertical leg and terminating in a second end;

a tapered portion defining said first end, said tapered portion adapted to be inserted into the gooseneck;

a fitting defining said second end, said fitting adapted to receive a filler nozzle; and a sleeve, said sleeve positioned on said first end and encompassing said tapered portion.

8. The device as recited in claim 7, wherein said horizontal leg has an outer surface, said device further comprising a finger ring, said finger ring being attached to the outer surface of said horizontal leg member.

9. The device as recited in claim 8, wherein said vertical leg member has a length of approximately nine and one-fourth inches.

10. The device as recited in claim 9, wherein said horizontal leg member has a length of approximately three and one-third inches.

11. The device as recited in claim 10, wherein said tubular member is fabricated from a metallic material.

12. The device as recited in claim 10, wherein said tubular member is fabricated from a plastic material.

* * * * *